US009308754B1

(12) United States Patent
Sasaki et al.

(10) Patent No.: US 9,308,754 B1
(45) Date of Patent: Apr. 12, 2016

(54) IMAGE FORMING APPARATUS AND IMAGE FORMING METHOD

(71) Applicants: Hitoshi Sasaki, Kanagawa (JP); Yuuichiroh Tsujiguchi, Kanagawa (JP); Takuji Kawaguchi, Kanagawa (JP); Shigeru Yoshigai, Kanagawa (JP); Keizoh Shigaki, Kanagawa (JP)

(72) Inventors: Hitoshi Sasaki, Kanagawa (JP); Yuuichiroh Tsujiguchi, Kanagawa (JP); Takuji Kawaguchi, Kanagawa (JP); Shigeru Yoshigai, Kanagawa (JP); Keizoh Shigaki, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/848,210

(22) Filed: Sep. 8, 2015

(30) Foreign Application Priority Data

Sep. 12, 2014 (JP) ..... 2014-186254
Aug. 24, 2015 (JP) ..... 2015-164473

(51) Int. Cl.
*B41J 29/38* (2006.01)
*B41J 13/00* (2006.01)

(52) U.S. Cl.
CPC ..... *B41J 13/0009* (2013.01)

(58) Field of Classification Search
CPC ..... B41J 11/42; B41J 17/14; B41J 13/009
USPC ..... 347/16
See application file for complete search history.

(56) References Cited

U.S. PATENT DOCUMENTS

2005/0157357 A1* 7/2005 Yamanaka ..... H04N 1/00572 358/498
2006/0269339 A1* 11/2006 Okamoto ..... G03G 15/6564 399/401
2008/0068681 A1* 3/2008 Ishido ..... H04N 1/00933 358/498
2009/0051720 A1* 2/2009 Uchino ..... B41J 3/60 347/16
2009/0315246 A1* 12/2009 Nishimura ..... B42C 1/12 271/3.14
2012/0070216 A1* 3/2012 Sochi ..... G03G 15/5087 400/76
2013/0321508 A1* 12/2013 Sano ..... B41J 13/0009 347/16
2014/0099135 A1* 4/2014 Hiratsuka ..... G03G 15/5054 399/66
2014/0233049 A1* 8/2014 Takemura ..... H04N 1/0005 358/1.12
2015/0273896 A1* 10/2015 Koizumi ..... B41J 3/60 347/10

FOREIGN PATENT DOCUMENTS

JP 2004-338215 12/2004
JP 2013-123822 6/2013

* cited by examiner

*Primary Examiner* — Matthew Luu
*Assistant Examiner* — Patrick King
(74) *Attorney, Agent, or Firm* — Duft Bornsen & Fettig LLP

(57) ABSTRACT

An image forming apparatus includes a conveyance unit configured to convey a recording medium; a reversing unit configured to reverse front and back sides of the recording medium; a recording head configured to reciprocatingly scan to form a first image on a first side of the recording medium, which is reciprocatingly conveyed by the conveyance unit at a first conveyance speed $V_1$, and a second image on a second side of the recording medium, which is conveyed at a second conveyance speed $V_2$ and ejected, in a case of performing a double-sided printing; and a control unit configured to control the first conveyance speed $V_1$ and the second conveyance speed $V_2$ to satisfy a relation $$V_2 \leq W/t < V_1 \leq (W/t) \times 2,$$

where t is a scanning time required for one reciprocation of the recording head, and W is an image formation width of the recording head.

5 Claims, 11 Drawing Sheets

IMAGE FORMING APPARATUS AND IMAGE FORMING METHOD

CROSS-REFERENCE TO RELATED APPLICATIONS

The present application is based on and claims the benefit of priority of Japanese Priority Applications No. 2014-186254 filed on Sep. 12, 2014 and No. 2015-164473 filed on Aug. 24, 2015, the entire contents of which are hereby incorporated by reference.

BACKGROUND OF THE INVENTION

1. Field of the Invention

The disclosures herein generally relate to an image forming apparatus and an image forming method.

2. Description of the Related Art

Ink jet recording apparatuses, each of which discharges ink on a recording medium conveyed in a sub scanning direction from a recording head reciprocating in a main scanning direction perpendicular to the sub scanning direction and thereby forms an image, are widely used. A conventional ink jet recording apparatus forms an image on a recording medium by repeating an operation of scanning with a recording head in a state where a conveyance of the recording medium is stopped to form an image and an operation of conveying the recording medium by a predetermined amount in a state where the recording head is decelerated or stops.

In this way, in forming an image by reciprocatingly scanning with the recording head while intermittently conveying the recording medium, a mechanical impact sound occurring during an operation such as a conveyance of a recording medium or scanning of a recording head, especially at a start and an end of the operation, may become irritating noise.

Then, a printer that reduces motion sound while forming an image by conveying a recording medium always at a constant rate without stopping the recording of the recording medium during image formation and shortening an accelerating time and decelerating time in reciprocatingly scanning with the recording head is proposed (see, for example, Japanese Published Patent Application No. 2004-338215).

According the printer disclosed in Japanese Published Patent Application No. 2004-338215, the motion sound while forming an image is reduced and quietness is improved. However, a conveyance speed for the recording medium is restricted by a scanning speed for the recording head, so that the whole print region of the recording medium can be scanned with the recording head for forming an image.

For an ink jet recording apparatus, enhancement of productivity, not limited to single-sided printing or double-sided printing, as well as quietness is also required. However, according to the above-described noise restriction, it may be difficult to enhance the productivity by increasing the conveyance speed for a recording medium.

SUMMARY OF THE INVENTION

It is a general object of at least one embodiment of the present invention to provide an image forming apparatus and an image forming method that substantially obviate one or more problems caused by the limitations and disadvantages of the related art.

In one embodiment, an image forming apparatus includes a conveyance unit configured to convey a recording medium in a sub scanning direction; a recording head configured to reciprocatingly scan in a main scanning direction perpendicular to the sub scanning direction, to form an image on the recording medium conveyed by the conveyance unit; a reversing unit configured to reverse front and back sides of the recording medium and convey the reversed recording medium to the conveyance unit; and a control unit configured to control a conveyance speed at which the conveyance unit conveys the recording medium. In a case of performing a double-sided printing, while the conveyance unit reciprocatingly conveys the recording medium, the recording head is controlled to form a first image on a first side of the recording medium, and while the conveyance unit conveys and ejects the reversed recording medium, front and back sides of which are reversed by the reversing unit, the recording head is controlled to form a second image on a second side of the recording medium. The control unit is configured to control a first conveyance speed $V_1$ upon forming the first image on the first side of the recording medium and a second conveyance speed $V_2$ upon forming the second image on the second side of the recording medium to satisfy a relation $$V_2 \leq W/t < V_1 \leq (W/t) \times 2$$

where t is a scanning time required for one reciprocation of the recording head in the main scanning direction, and W is an image formation width of the recording head in the sub scanning direction.

In another embodiment, an image forming method is executed in an image forming apparatus. The image forming apparatus includes a conveyance unit configured to convey a recording medium in a sub scanning direction; a recording head configured to reciprocatingly scan in a main scanning direction perpendicular to the sub scanning direction, to form an image on the recording medium conveyed by the conveyance unit; and a reversing unit configured to reverse front and back sides of the recording medium and convey the reversed recording medium to the conveyance unit. In a case of performing a double-sided printing, while the conveyance unit reciprocatingly conveys the recording medium, the recording head forms a first image on a first side of the recording medium, and when the conveyance unit conveys and ejects the reversed recording medium, front and back sides of which are reversed by the reversing unit, the recording head forms a second image on a second side of the recording medium. The method includes controlling a first conveyance speed $V_1$ at which the conveyance unit conveys the recording medium upon forming the first image on the first side of the recording medium and a second conveyance speed $V_2$ at which the conveyance unit conveys the reversed recording medium upon forming the second image on the second side of the recording medium to satisfy a relation $$V_2 \leq W/t < V_1 \leq (W/t) \times 2$$

where t is a scanning time required for one reciprocation of the recording head in the main scanning direction, and W is an image formation width of the recording head in the sub scanning direction.

According to the embodiment of the present application, an image forming apparatus, which is excellent at quietness and in which productivity for a double-sided printing is enhanced, is provided.

BRIEF DESCRIPTION OF THE DRAWINGS

Other objects and further features of embodiments will become apparent from the following detailed description when read in conjunction with the accompanying drawings, in which.

DESCRIPTION OF THE PREFERRED EMBODIMENTS

Figure 1:
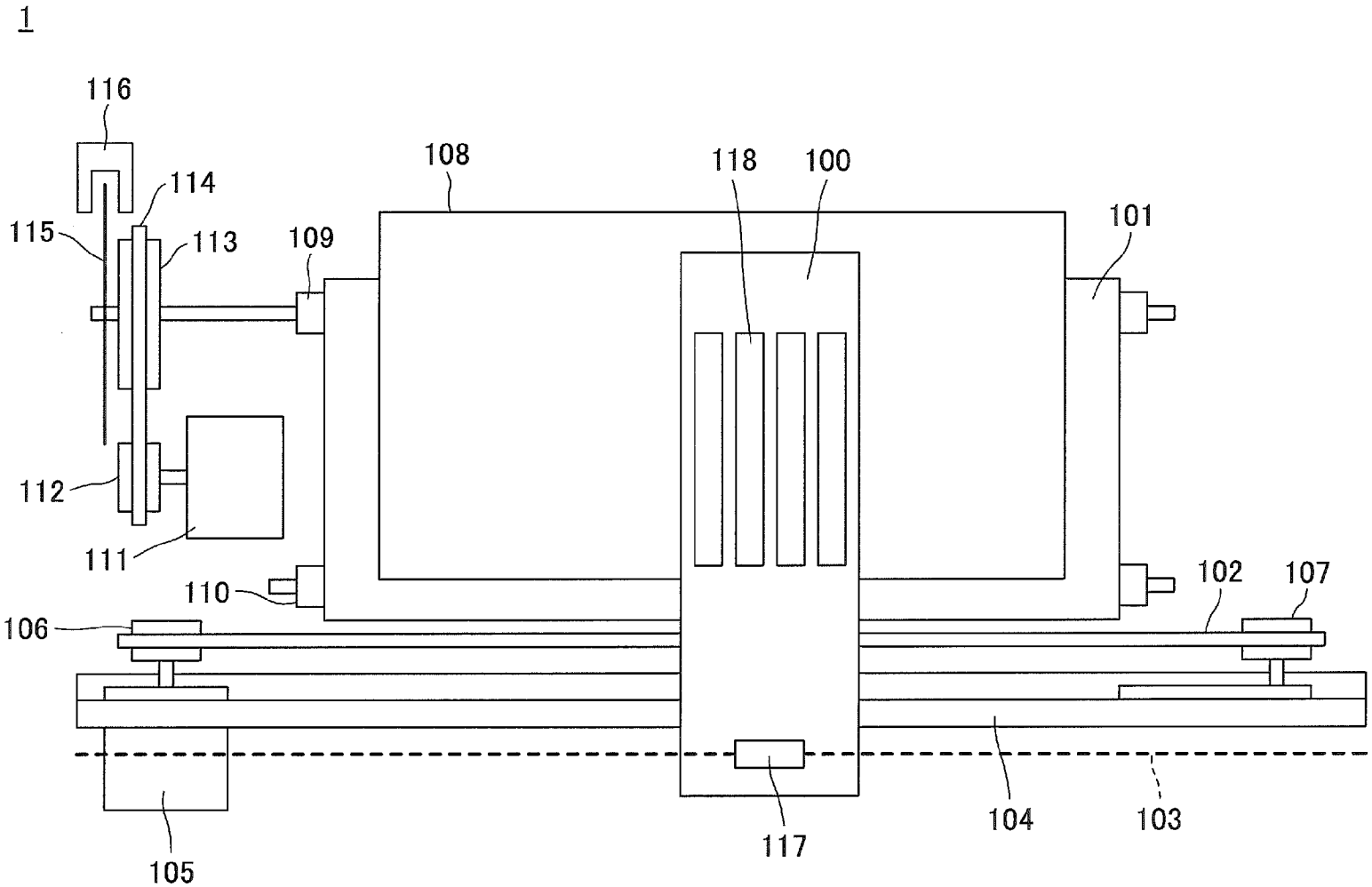
FIG. 1 is a schematic top view illustrating an example of a configuration of an ink jet recording apparatus according to a present embodiment.

In the following, embodiments of the present invention will be described with reference to the accompanying drawings. In the respective drawings, the same reference numeral is assigned to the same component and duplicate explanation may be omitted.

[Configuration of Ink Jet Recording Apparatus]

A configuration of an ink jet recording apparatus 1 according to a present embodiment will be explained. Meanwhile, in the following, a case where the ink jet recording apparatus 1 forms an image on paper as a recording medium will be exemplified. However, the recording medium is not limited to paper, and may be film, cloth or the like.

FIG. 1 is a schematic top view illustrating an example of a configuration of the ink jet recording apparatus 1 according to the present embodiment.

As shown in FIG. 1, the ink jet recording apparatus 1 according to the present embodiment includes a carriage 100 in which a recording head 118 for discharging ink to a conveyed paper 108 to form an image is installed.

The carriage 100 is held on a slide rail 104 movably in a main scanning direction (horizontal direction in the drawing). Moreover, on the carriage is fixed a part of a timing belt 102, which is stretched between a driving pulley 106 and a driven pulley 107, provided along the slide rail 104, and rotates by following the driving pulley.

In a case where a main scanning motor 105 connected to the driving pulley 106 drives, the timing belt 102 rotates by following the driving pulley 106, and the carriage 100 fixed to the timing belt 102 moves in the main scanning direction along the slide rail 104.

In the carriage 100, a main scanning encoder sensor 117 used for position detection in the main scanning direction is installed. The main scanning encoder sensor 117 moves in the main scanning direction with the carriage 100, and plural slits are provided on an encoder scale 103. A position of the carriage 100 in the main scanning direction can be obtained based on a detection result for the slit on the encoder scale 103 by the main scanning encoded sensor 117.

The recording head 118 installed in the carriage 100 includes, for example, four liquid drop discharge heads discharging ink droplets of respective colors of yellow, cyan, magenta, black and the like. The recording head 118 is held in the carriage 100 so that a nozzle surface, on which plural ink discharge ports (nozzles) of the respective liquid drop discharge heads are arranged, is opposed to a surface of the conveyed paper 108. Meanwhile, a number, color or the like of the liquid drop discharge heads provided in the recording head 118 are not limited to the configuration illustrated in the present embodiment.

The recording head 118 discharges ink droplets from the respective liquid drop discharge heads while reciprocating in the main scanning direction with the carriage 100 according to the above-described configuration, and forms an image in a print region on the paper 108 conveyed in the sub scanning direction perpendicular to the main scanning direction.

The paper 108 is conveyed in the sub scanning direction by a conveyance belt 101. The conveyance belt 101 is an endless belt which is stretched over a conveyance roller 109 and a tension roller 110 and rotates in the sub scanning direction. The conveyance belt 101 is charged by a charging roller (not shown), and causes the paper 108 to electrostatically adhere to the belt and conveys the paper 108 in the sub scanning direction.

A timing belt 114 is stretched between a conveyance roller pulley 113 provided at an end of a rotational axis of the conveyance roller 109 and a conveyance driving pulley 112 connected to a sub scanning motor 111. In a case where the sub scanning motor 111 drives rotationally, the conveyance roller 109 rotates via the conveyance driving pulley 112, the timing belt 114 and the conveyance roller pulley 113, and the conveyance belt 101 rotates driven by the conveyance roller 109.

Moreover, at an end of the rotational axis of the conveyance roller 109, an encoder wheel 115 on which plural slits are formed at equal intervals in a circumferential direction is arranged. Furthermore, a sub scanning encoder sensor 116 for detecting the slit on the encoder wheel 115 rotating with the conveyance roller 109 is fixedly arranged. From an amount of rotation of the conveyance belt 101 obtained based on a detection result by the sub scanning encoder sensor 116, a conveyance position of the paper 108 in the sub scanning direction can be obtained.

The conveyance belt 101, the sub scanning motor 111 or the like is an example of a conveyance means. The conveyance belt 101 continuously conveys a paper 108 supplied from a paper feeding tray (not shown) without stopping during printing, and ejects the paper 108 on which an image is formed to the outside of the apparatus.

Figure 2:
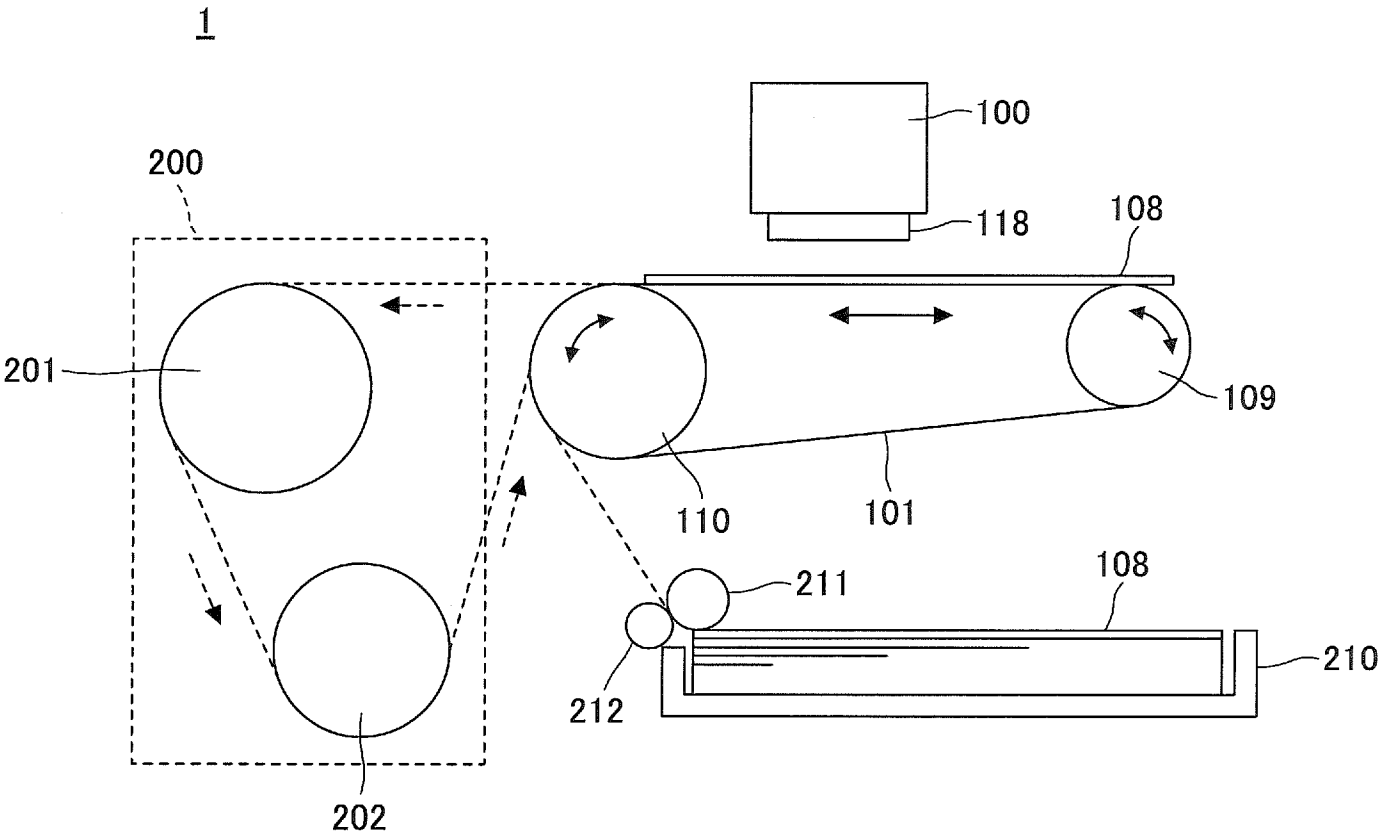
FIG. 2 is a schematic side view illustrating an example of the configuration of the ink jet recording apparatus according to the present embodiment.

FIG. 2 is a schematic side view illustrating an example of the configuration of the ink jet recording apparatus 1 according to the present embodiment.

As shown by an arrow in FIG. 2, the conveyance roller 101 can rotate in both directions according to a normal rotation direction or a reverse rotation direction of the sub scanning motor 111 connected to the conveyance roller 109, and can convey the paper 108 in both directions along the sub scanning direction (horizontal direction in FIG. 2).

Moreover, the ink jet recording apparatus 1 according to the present embodiment is provided with a reversing device 200 having a reversed conveyance path connected to the conveyance path of the paper 108 by the conveyance belt 101.

The reversing device 200 is an example of a reversing means, and includes reversing conveyance rollers 201, 202. The reversing device 200 conveys the paper 108, which is conveyed from the conveyance belt 101, by the reversing conveyance rollers 201, 202, reverses front and back sides of the paper 108, and sends the paper 108 into the conveyance belt 101 again.

In the ink jet recording apparatus 1, a paper 108 is supplied from a paper tray 210, which accommodates plural papers 108, to the conveyance belt 101 by paper feeding conveyance rollers 211, 212. The conveyance belt 101 conveys the paper 108 along the sub scanning direction by causing the supplied paper 108 to electrostatically adhere to the belt and rotating. For the paper 108 conveyed in the sub scanning direction by the conveyance belt 101, the recording head 118 installed in the carriage 100 reciprocates in the main scanning direction to form an image on the paper 108.

In a case of double-sided printing, the paper 108, after an image is formed on a first side of the paper 108, front and back sides of the paper 108 are reversed by the reversing device 200 and the paper 108 is conveyed by the conveyance belt 101 again. After another image is formed on a second side of the paper 108, the paper is ejected to the outside of the apparatus.

Figure 3:
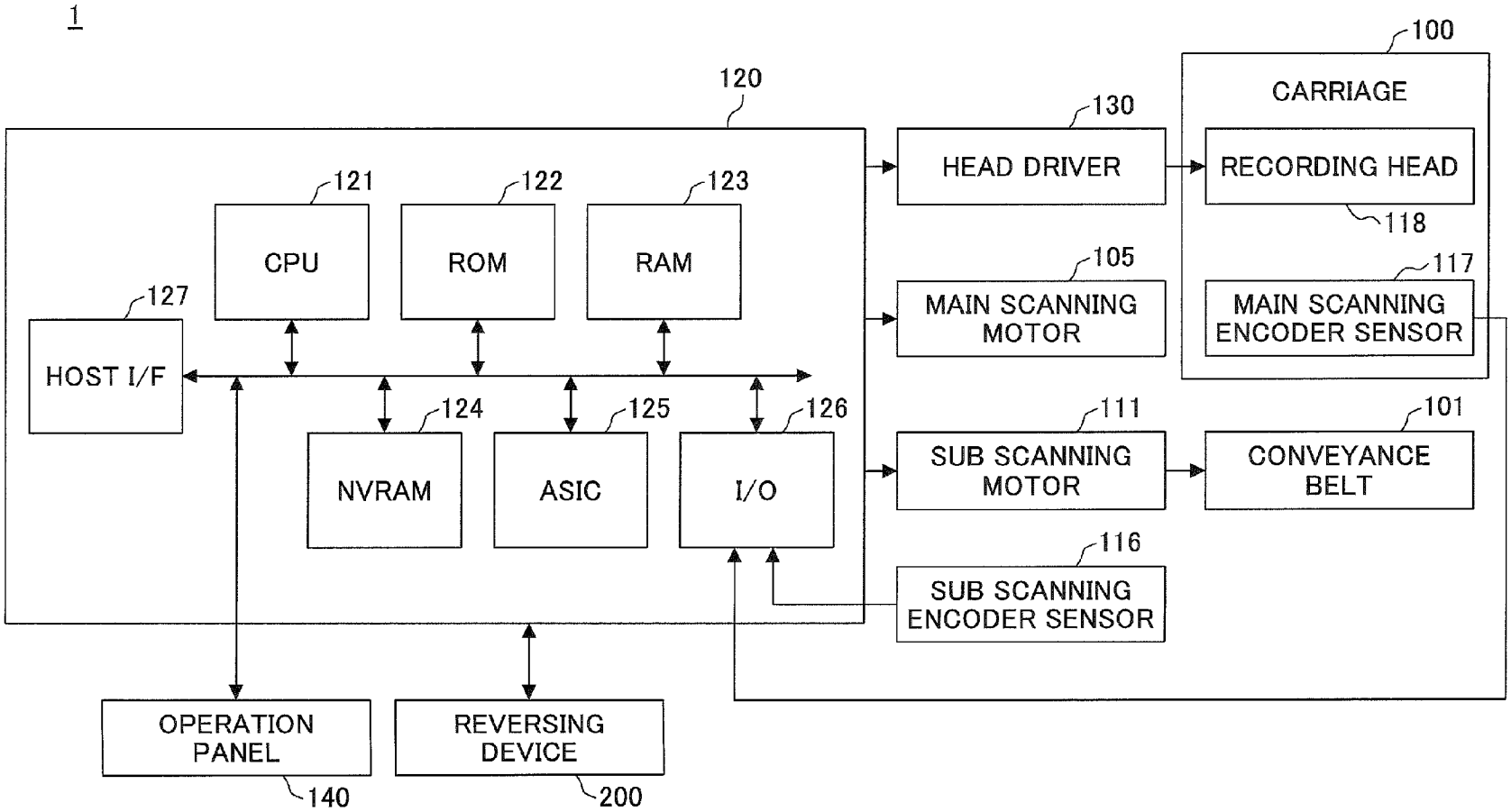
FIG. 3 is a block diagram illustrating an example of the configuration of the ink jet recording apparatus according to the present embodiment.

FIG. 3 is a block diagram illustrating an example of a configuration of the ink jet recording apparatus 1 according to the present embodiment.

As shown in FIG. 3, the ink jet recording apparatus includes a control unit 120, a head driver 130, the carriage 100, the main scanning motor 105, the sub scanning motor 111, the conveyance belt 101, the sub scanning encoder sensor 116, an operation panel 140 and the reversing device 200.

The control unit 120 is an example of a control means, includes an CPU (Central Processing Unit) 121, a ROM (Read-Only Memory) 122, a RAM (Random Access Memory) 123, an NVRAM (Non-Volatile Random Access Memory) 124, an ASIC (Application Specific Integrated Circuit) 125, an I/O 126 and a host I/F 127, and controls respective components of the ink jet recording apparatus 1.

The ROM 122 stores various programs, data used by programs or the like. The RAM 123 is used as a storage area in which a program is uploaded, a work area for the uploaded program or the like. The CPU 121 realizes various functions by processing the programs uploaded in the RAM 123. The NVRAM 124 stores various control information or the like.

The ASIC 125 performs various signal processes for image data to be inputted to the ink jet recording apparatus 1, an image process for performing sorting or other process for input/output signal to control the whole apparatus. The I/O 126 performs inputting/outputting signals to/from the main scanning encoder sensor 117 or the sub scanning encoder sensor 116. The host I/F 127 sends/receives, for example, image data, various signals or the like to/from an external device such as a PC connected to the ink jet recording apparatus 1 by wire or wirelessly.

The control unit 120 performs an image process or the like for image data to be input to the host I/F 127, and outputs the image data, for which the image process is performed, or a driving waveform to the head driver 130. The head driver 130 causes the recording head 118 to discharge ink by selectively applying a driving pulse included in the inputted driving waveform to a pressure generation means of the recording head 118.

The main scanning motor 105 causes the carriage 100 to move with the recording head 118 in the main scanning direction by being rotationally driven and controlled by the control unit 120. The main scanning encoder sensor 117 moves with the carriage 100 in the main scanning direction, detects slits on the encoder scale 103 and outputs a detection signal to the I/O 126 of the control unit 120.

The sub scanning motor 111 causes the conveyance belt 101 to rotate to convey a paper 108 by being rotationally driven and controlled by the control unit 120. The sub scanning encoder sensor 116 detects slits on the encoder wheel 115 and outputs a detection signal to the I/O 126 of the control unit 120.

The operation panel 140 is hardware provided with an inputting means such as a button or the like to receive an input from a user, an operation screen such as a liquid crystal panel having a touch panel function or the like, and is connected to the control unit 120.

The reversing device 200 has a configuration illustrated in FIG. 2, reverses front and back sides of the paper 108 conveyed from the conveyance belt 101, and conveys the paper 108, front and back sides of which are reversed, to the conveyance belt 101 again.

The ink jet recording apparatus 1 according to the present embodiment has the above-described configuration. In accordance with a printing condition such as a single-sided printing or a double-sided printing, the control unit 120 controls the respective components to change a conveyance path, a conveyance speed or the like of the paper 108.

[Print Operation]

Next, a print operation of the ink jet recording apparatus 1 will be explained. FIGS. 4A to 4C, 5, 6A and 6B are diagrams for explaining the print operation at the ink jet recording apparatus 1.

(Single-Sided Printing)

Figure 4A:
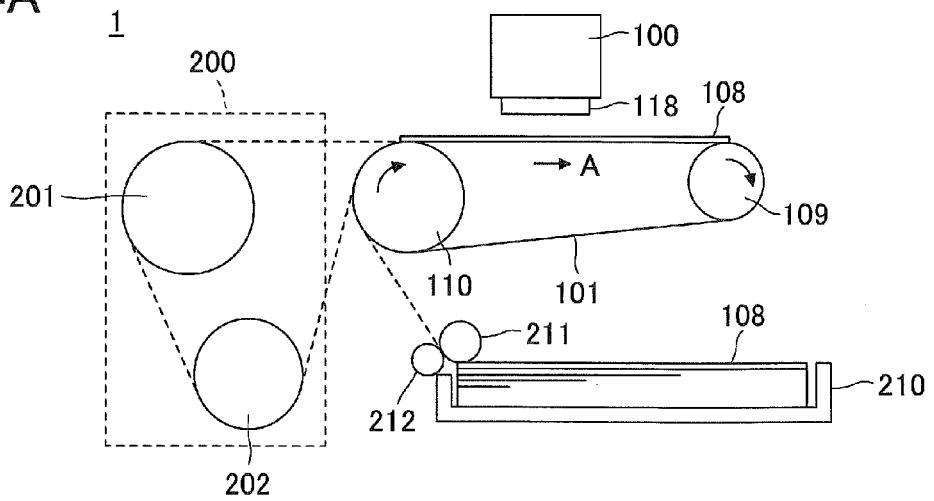
FIGS. 4A to 4C are diagrams illustrating an example of a print operation of the ink jet recording apparatus according to the present embodiment.

In a case of a single-sided printing, as shown in FIG. 4A, the paper 108 supplied from the paper tray 210 to the conveyance belt 101 is conveyed in a direction indicated by an arrow "A". The recording head 118 forms an image on a first side of the paper 108. The paper 108 is directly conveyed to the conveyance belt 101 and ejected to the outside of the apparatus.

Figure 5:
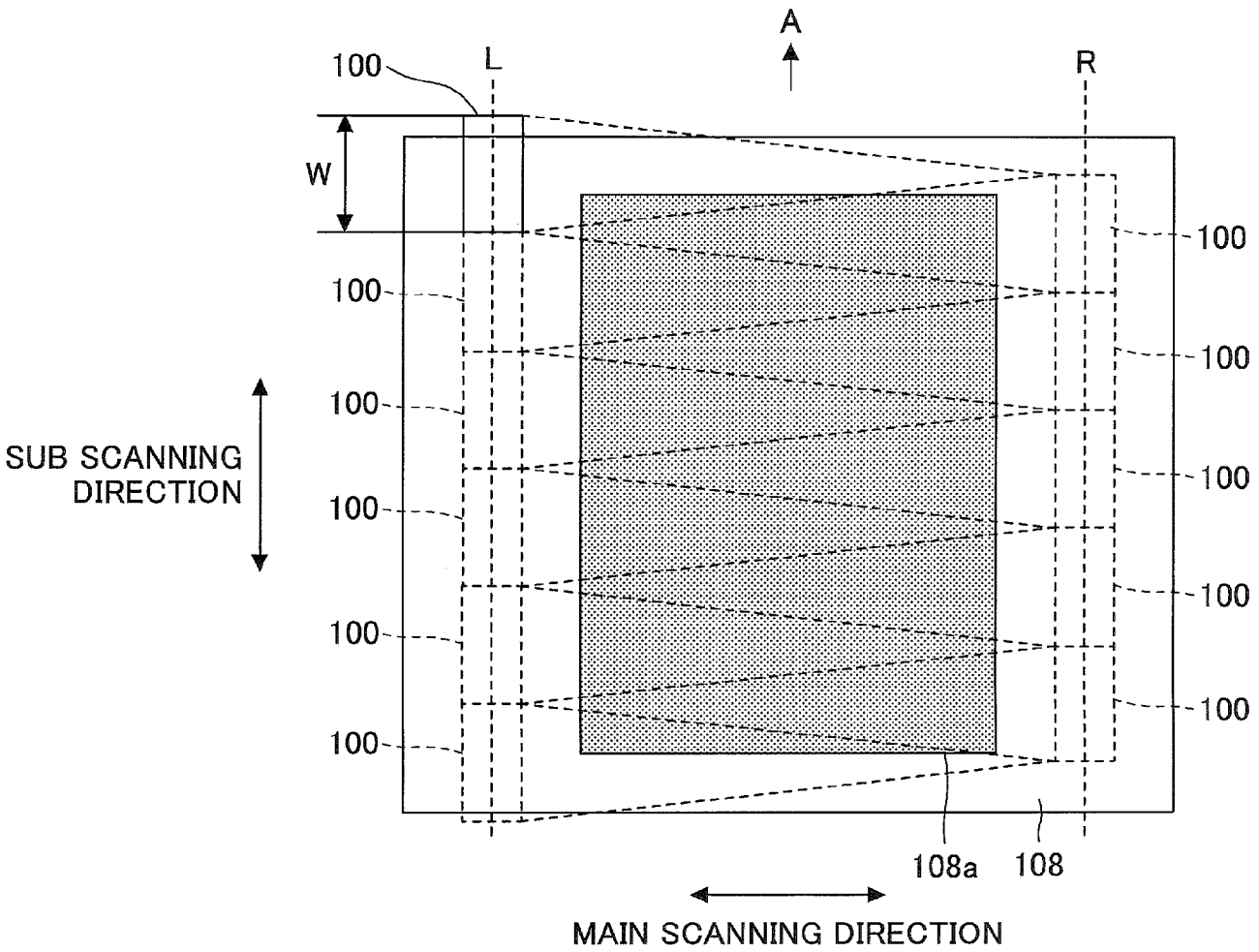
FIG. 5 is a diagram for explaining a print operation on single-sided printing in the ink jet recording apparatus according to the present embodiment.

In the single-sided printing, as shown in FIG. 5, for the paper 108 conveyed in a direction indicated by an arrow "A" in the sub scanning direction, the carriage 100 reciprocates between a position "L" and a position "R" in the main scanning direction. The recording head 118 installed in the carriage 100 reciprocates with the carriage 100 in the main scanning direction, discharges ink droplets and forms an image in a print region 108*a* of the paper 108.

In the ink jet recording apparatus 1 according to the present embodiment, the paper 108 is continuously conveyed in the sub scanning direction without stopping during the carriage 100 scanning (printing). Accordingly, the carriage 100 scans, as shown in FIG. 5, for the conveyed paper 108, in an oblique direction (a direction inclined from the conveyance direction of the paper 108 and a direction perpendicular to the conveyance direction).

Here, the conveyance speed Va of the paper 108 upon performing the single-sided printing is controlled so that the following formula (1) is satisfied. Meanwhile, t is a scanning time required for one reciprocation of the carriage 100 in the main scanning direction, and W is a width (image formation width) in the sub scanning direction of a nozzle array arranged on the recording head 118.

[Equation 1]

$$Va \leq W/t \quad (1)$$

In a case where the conveyance speed Va of the paper 108 is controlled so that the above-described formula (1) is satisfied, a conveyance length of the paper 108 during one reciprocation of the carriage 100 is less than or equal to the image formation width W of the recording head 118. By controlling the conveyance speed Va in this way, as shown in FIG. 5, upon performing the single-sided printing, the recording head 118 scans the whole region of the print region 108*a* of the paper 108, and thereby forms an image without leaving a space.

(Double-Sided Printing)

Figure 4B:
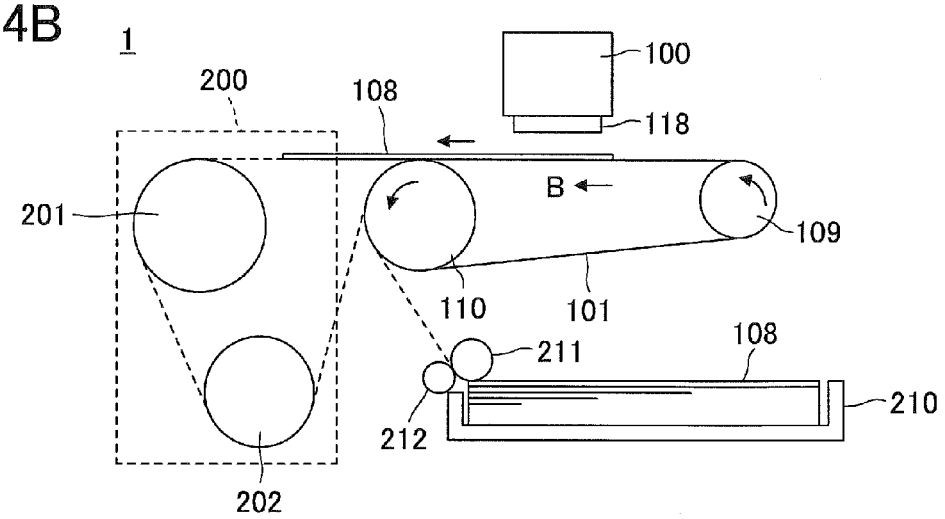

In a case of a double-sided printing, at first, as shown in FIG. 4A, the paper 108 supplied from the paper tray 210 to the conveyance belt 101 is conveyed in a direction indicated by an arrow "A". The paper 108 passes an image formation position at which the recording head 118 forms an image. Next, as shown in FIG. 4B, the paper 108 is conveyed in a direction indicated by an arrow "B". The paper 108 passes the image formation position opposed to the recording head 118 again, and is sent to the reversing device 200.

While being reciprocatingly conveyed in the sub scanning direction and passing twice the image formation position in this way, an image is formed in the print region 108*a* on the first side of the paper 108 by the recording head 118 which reciprocates with the carriage 100 in the main scanning direction.

Here, the conveyance speed Vb of the paper 108 upon printing on the first side in the double-sided printing is controlled so that the following formula (2) is satisfied. Meanwhile, as in the above-described formula (1), W is a width (image formation width) in the sub scanning direction of a nozzle array arranged on the recording head 118, and t is a scanning time required for one reciprocation of the carriage 100 in the main scanning direction.

[Equation 2]

$$W/t < Vb \leq (W/t) \times 2 \quad (2)$$

In the ink jet recording apparatus 1 according to the present embodiment, in the first side printing of the double-sided printing, at first, the paper 108 is conveyed in a direction indicated by the arrow "A" shown in FIG. 4A at the conveyance speed Vb, passes the image formation position and a first image formation is performed by the recording head 118.

Figure 6A:
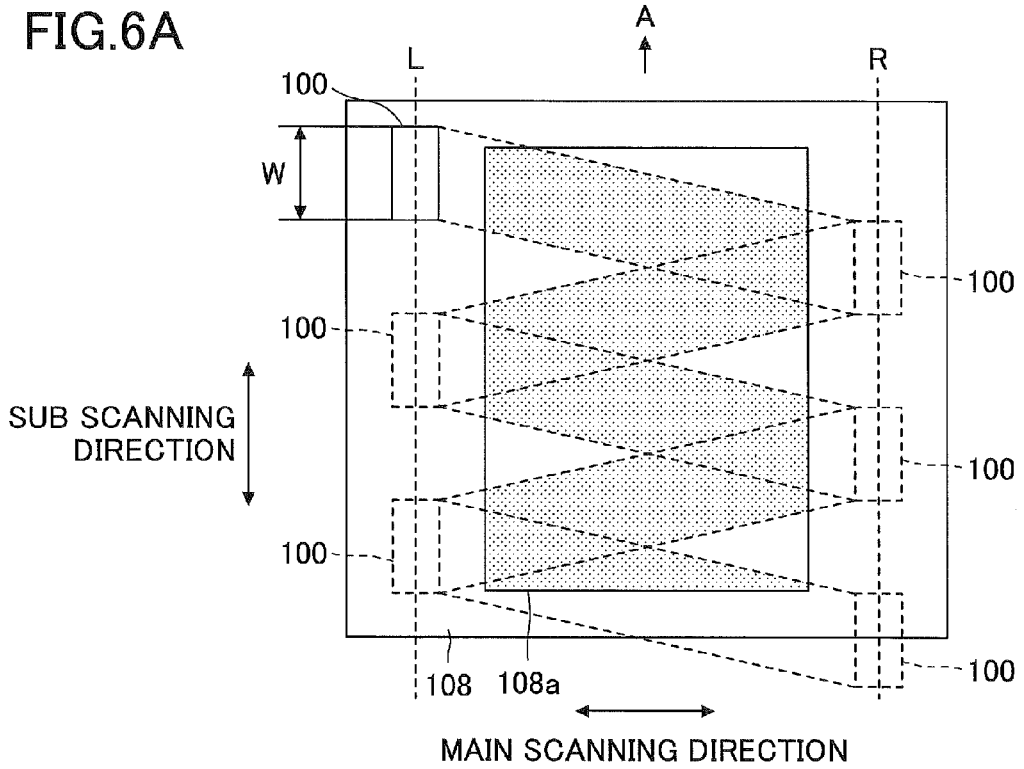
FIGS. 6A and 6B are diagrams for explaining a print operation on printing a first side in double-sided printing in the ink jet recording apparatus according to the present embodiment.

At this time, in a case where the conveyance speed Vb of the paper 108 is controlled so that the above-described formula (2) is satisfied, a conveyance length of the paper 108 during one reciprocation of the carriage 100 becomes greater than the image formation width W of the recording head 118. Therefore, in the first image formation, as shown in FIG. 6A, the whole region of the print region 108*a* of the paper 108 is not scanned by the recording head 118, and a space where an image is not formed is left.

After the paper 108 is conveyed in the direction indicated by the arrow "A" and the first image formation is performed, the paper 108 is conveyed in a direction indicated by an arrow "B" shown in FIG. 4B at the conveyance speed Vb, passes the image formation position again and a second image formation is performed by the recording head 118.

Figure 6B:
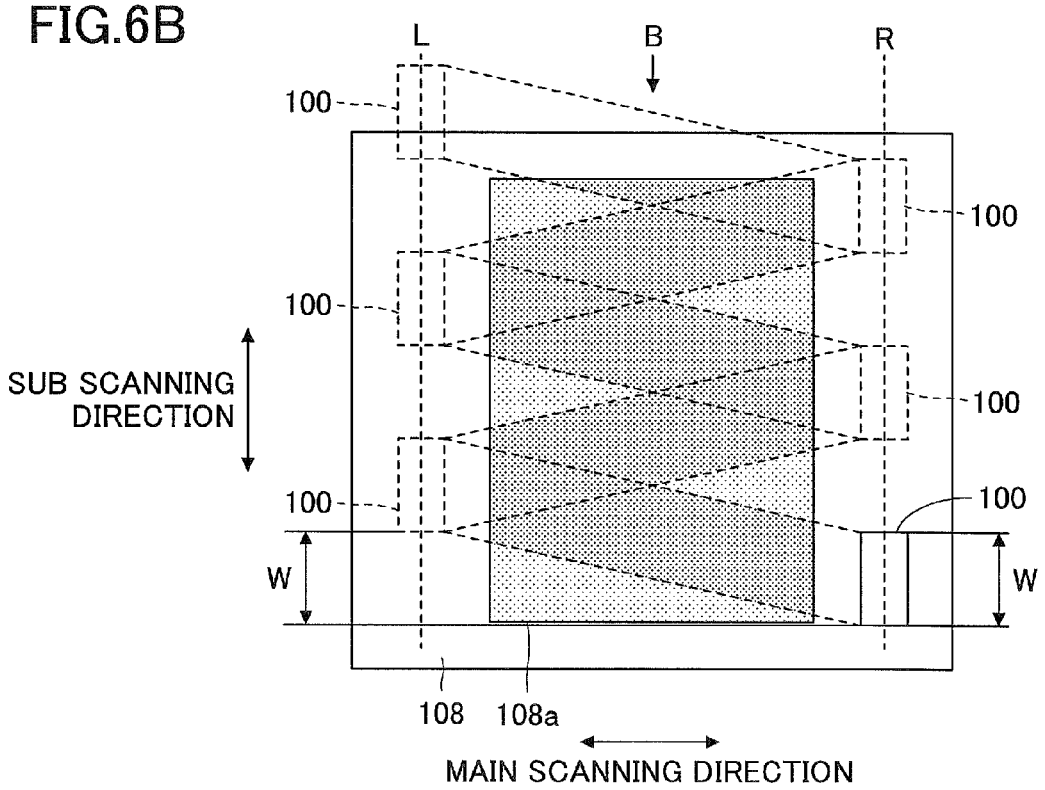

In the second image formation, as shown in FIG. 6B, the recording head 118 scans a region where an image is not formed in the first image formation, and forms an image. In this way, by causing the paper 108 to pass the image formation position again and performing the second image formation, an image is formed in the whole region of the print region 108*a*, and printing on the first side of the paper 108 is completed.

Figure 4C:
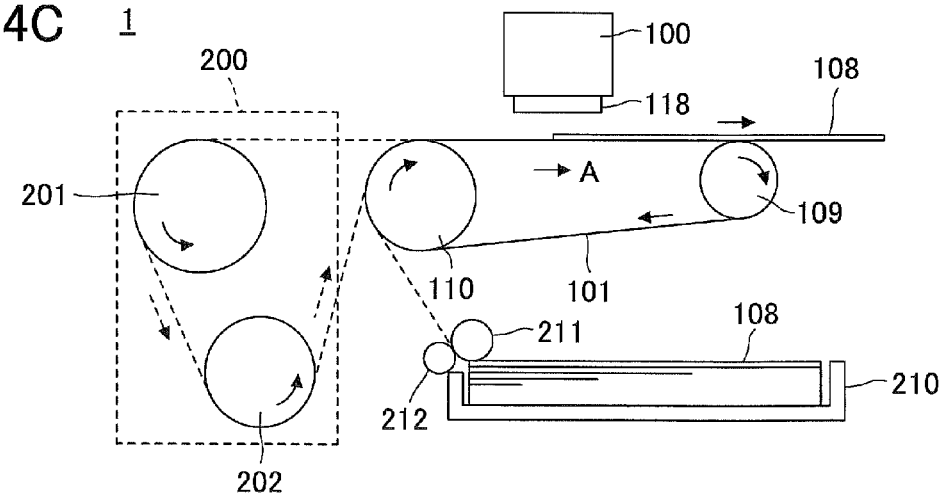

Upon the first side printing for the paper 108 being completed, as shown in FIG. 4C, the paper 108 is conveyed to the reversing device 200. The paper 108 is conveyed again in the conveyance belt 101 in a state where front and back sides of the paper 108 are reversed. Then, an image is formed in a print region of a second side by the recording head 118. Upon performing the second side printing of the double-sided printing, the paper 108 is conveyed at the conveyance speed Va, which satisfies the above-described formula (1), in the same way as in the single-sided printing, passes the image formation position, and an image is formed in the whole print region on the second side by the recording head 118.

The paper 108, on both sides of which images are formed, in this way, is conveyed by the conveyance belt 101 and is ejected to the outside of the apparatus; thereby the double-sided printing at the ink jet recording apparatus 1 ends.

As explained above, in the ink jet recording apparatus 1 according to the preset embodiment, upon performing the first side printing of the double-sided printing, an image formation is performed while the paper 108 is being reciprocatingly conveyed at the conveyance speed Vb which is greater than the conveyance speed Va on the single sided printing. Therefore, in the ink jet recording apparatus 1, the double-sided printing can be performed more quickly, compared with the case of, for example, performing from the beginning of the first side printing to the end of the second side printing at the constant conveyance speed Va.

[Print Process]

Figure 7:
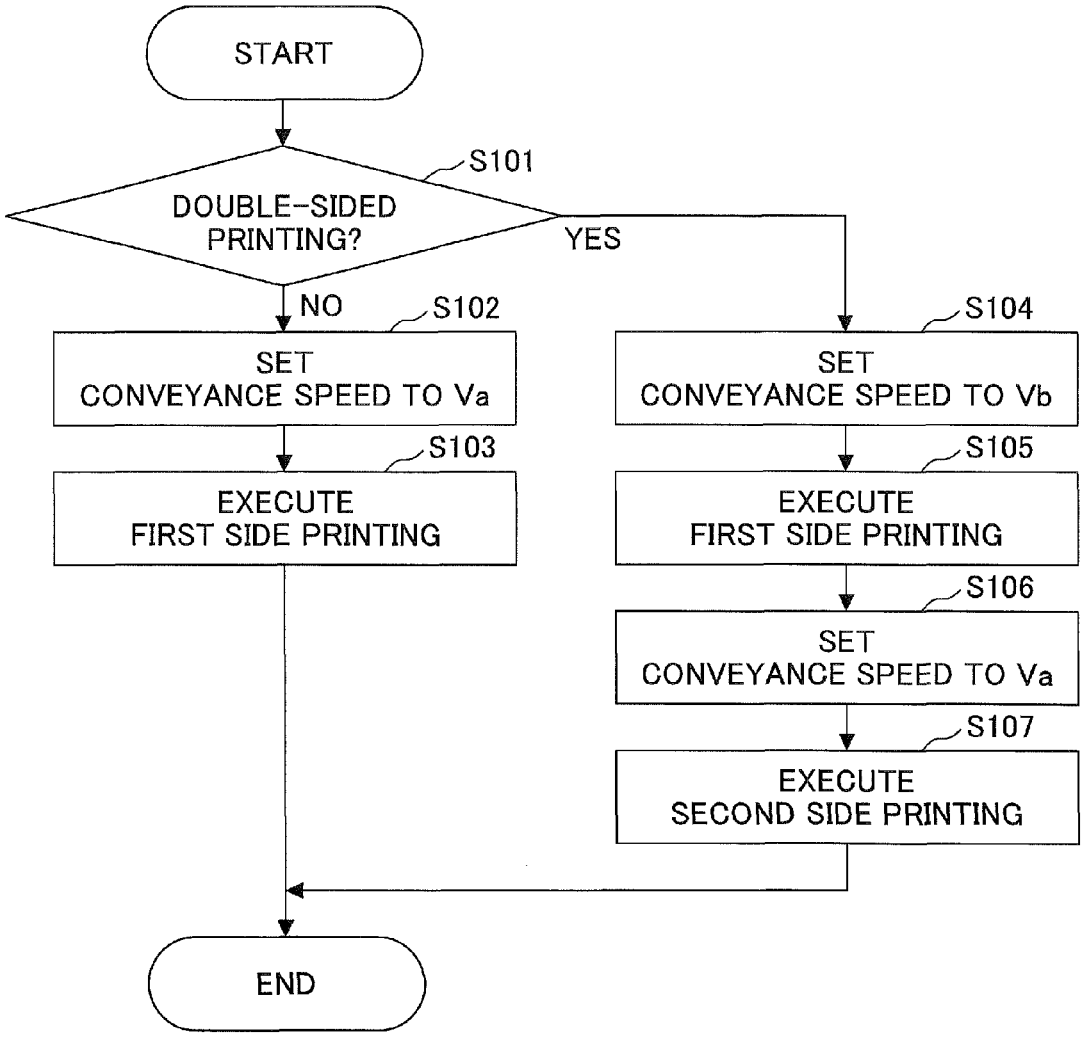
FIG. 7 is a flowchart illustrating a first example of a print process according to the present embodiment.

Next, the print process according to the present embodiment will be explained. FIG. 7 is a flowchart illustrating an example of the print process according to the present embodiment.

As shown in FIG. 7, upon a print request being inputted to the ink jet recording apparatus 1, at first the control unit 120 determines whether the inputted print request is for the single-sided printing or the double-sided printing (step S101). Print data including print control information sent from a printer driver of a PC, which is connected to the ink jet recording apparatus 1, or PDL (Page Description Language) data or the like are inputted to the ink jet recording apparatus 1. The print control information includes information such as color printing/monochrome printing, resolution, image quality, printing speed, single-sided printing/double-sided printing, necessity of rotation or a number of pages, etc. The control unit 120 determines whether the print request inputted to the ink jet recording apparatus 1 is the single-sided printing or the double-sided printing by analyzing the print control information included in the print data.

In the case of the single-sided printing (step S101: NO), the control unit 120 sets the conveyance speed Va for the paper 108 to a predetermined value within the range defined by formula (1) (step S102). Next, the control unit 120 controls the recording head 118 to form an image on a first side of the paper 108 conveyed at the conveyance speed Va (step S103). Then, the single-sided printing ends.

In the case of the double-sided printing (step S101: YES), the control unit 120 sets the conveyance speed Vb for the paper 108 to a predetermined value within the range defined by formula (2) (step S104). Next, the paper 108 is reciprocatingly conveyed at the conveyance speed Vb, the control unit 120 controls the recording head 118 to perform image formation twice on a first side of the paper 108 which is reciprocatingly conveyed at the conveyance speed Vb, and forms an image on the first side of the paper 108 (step S105).

Subsequently, the control unit 120 sets the conveyance speed Va for the paper 108 to a predetermined value within the range defined by formula (1) (step S106). Next, the control unit 120 controls the recording head 118 to form an image on a second side of the paper 108 which is conveyed at the conveyance speed Va (step S107).

In the ink jet recording apparatus 1 according to the present embodiment, by the above-described print process, an image is formed on one side or on both sides of the paper 108.

(High-Speed Double-Sided Printing Mode)

In the ink jet recording apparatus 1, in a case where the conveyance speed is increased upon performing the first side printing of the double-sided printing, sound arising from the sub scanning motor 111 or the conveyance belt 101 becomes greater. In a case where the ink jet recording apparatus 1 is installed in a quiet environment, the sound may become unwanted noise. Then, the ink jet recording apparatus 1 may include a high-speed double-sided printing mode, and may be configured so that in a case where the high-speed double-sided printing mode is set, the first side printing of the double-sided printing is speeded up.

Figure 8:
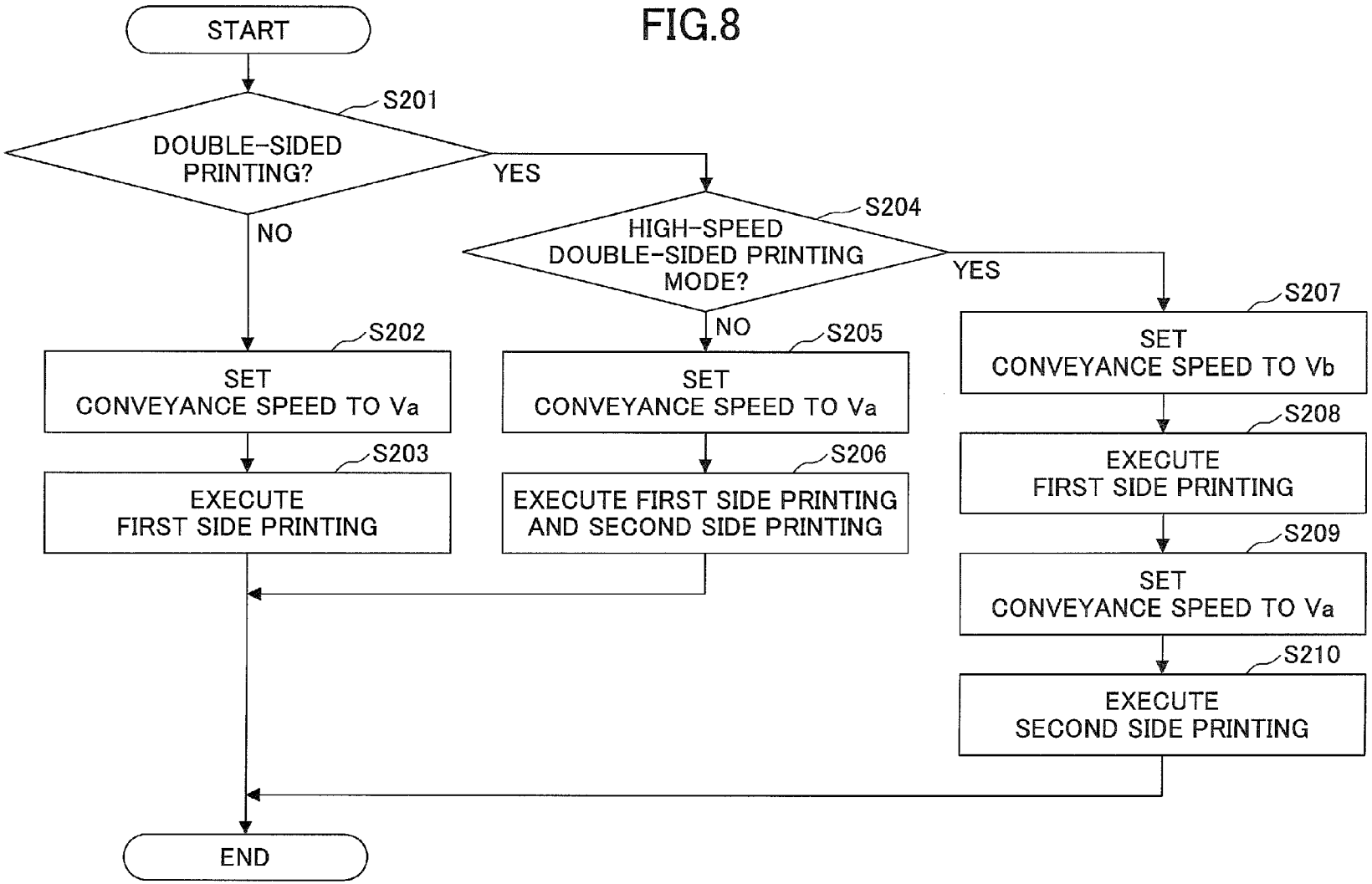
FIG. 8 is a flowchart illustrating a second example of a print process according to the present embodiment.

FIG. 8 is a flowchart illustrating an example of a print process at an ink jet recording apparatus 1 having a high-speed double-sided printing mode.

As shown in FIG. 8, upon a print request being inputted to the ink jet recording apparatus 1, at first the control unit 120 determines whether the inputted print request is for the single-sided printing or the double-sided printing (step S201). The control unit 120 determines whether the print request inputted to the ink jet recording apparatus 1 is for the single-sided printing or the double-sided printing by analyzing the print control information included in print data sent from a printer driver of a PC, which is connected to the ink jet recording medium 1.

In a case of the single-sided printing (step S201: NO), the control unit 120 sets the conveyance speed Va for the paper 108 to a predetermined value within the range defined by formula (1) (step S202). Next, the control unit 120 controls the recording head 118 to form an image on a first side of the paper 108 conveyed at the conveyance speed Va (step S203). Then the single-sided printing ends.

In the case of the double-sided printing (step S201: YES), the control unit 120 determines whether the high-speed double-sided printing mode is set (step S204). The print control information in the print data sent from the printer driver of the PC connected to the ink jet recording apparatus 1 includes control information on the high-speed double-sided printing mode. The control unit 120 determines whether the high-speed double-sided printing mode is set by analyzing the print control information.

Moreover, in a case where various print conditions, such as the high-speed double-sided printing mode, can be set by using the operation panel 140 in the ink jet recording apparatus 1, for example, the control unit 120 acquires control information stored in a memory or the like, and determines whether the high-speed double-sided printing mode is set.

In a case where the high-speed double-sided printing mode is not set (step S204: NO), the control unit 120 sets the conveyance speed Va for the paper 108 to a predetermined value within the range defined by formula (1) (step S205).

Next, on a first side and on a second side of the paper 108 conveyed at the conveyance speed Va respective images are formed (step S206). In this case, the first side printing for the paper 108 is performed upon the paper 108 passing the image formation position opposed to the recording head 118 in either direction.

In a case where the high-speed double-sided printing mode is set (step S204: YES), the control unit 120 sets the conveyance speed Vb for the paper 108 to a predetermined value within the range defined by formula (2) (step S207). Next, the control unit 120 controls the recording head 118 to perform image formation twice on a first side of the paper 108 which is reciprocatingly conveyed at the conveyance speed Vb, and forms an image on the first side of the paper 108 (step S208).

Subsequently, the control unit 120 sets the conveyance speed Va for the paper 108 to a predetermined value within the range defined by formula (1) (step S209). Next, the control unit 120 controls the recording head 118 to form an image on a second side of the paper 108 which is conveyed at the conveyance speed Va (step S210). Then, the process ends.

In this way, in the case where the high-speed double-sided printing mode is set in the ink jet recording apparatus 1, the conveyance speed upon performing the first side printing of the double-sided printing is increased, and productivity is enhanced. Moreover, in the case where the high-speed double-sided printing mode is not set, the conveyance speed of the paper 108 is suppressed, and quietness is enhanced.

(Paper Type Correspondence)

The ink jet recording apparatus 1 according to the present embodiment can form an image on various types of paper 108. However, depending on a type of paper 108, ink discharged from the recording head 118 may be hard to dry, and upon being conveyed shortly after printing, the ink may adhere to the conveyance belt 101 or a reversing conveyance path of the reversing device 200, thereby an inside of the apparatus may be contaminated.

For example, on a glossy paper or the like, ink discharged from the recording head 118 is hard to dry, so that upon being conveyed after the first side printing of the double-sided printing, the inside of the apparatus may be possibly contaminated with the ink. Then, for example, in a case where the paper 108 to be printed is a glossy paper, in order to secure time for ink drying, the printing may be executed at reduced conveyance speed, and in a case where the paper 108 to be printed is not a glossy paper, the first side printing of the double-sided printing may be speeded up by increasing the conveyance speed.

Figure 9:
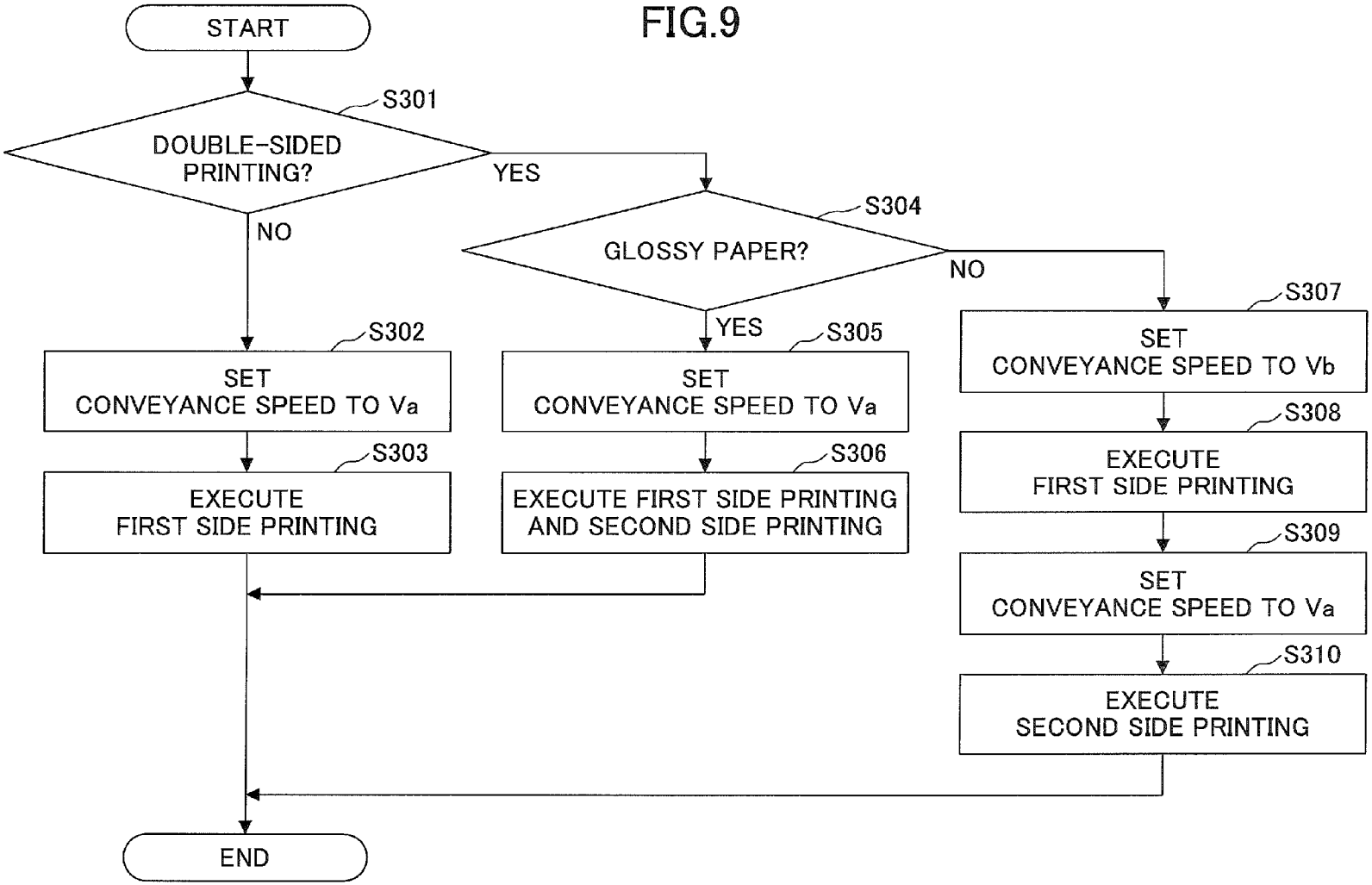
FIG. 9 is a flowchart illustrating a third example of a print process according to the present embodiment.

FIG. 9 is a flowchart illustrating a print process which changes the conveyance speed corresponding to a type of paper 108.

As shown in FIG. 9, upon a print request being inputted to the ink jet recording apparatus 1, at first the control unit 120 determines whether the inputted print request is for a single-sided printing or a double-sided printing (step S301). The control unit 120 determines whether it is the single-sided printing or the double-sided printing by analyzing print control information included in print data sent from a printer driver of a PC connected to the ink jet recording apparatus 1.

In a case of the single-sided printing (step S301: NO), the control unit 120 sets a conveyance speed Va for the paper 108 to a predetermined value within the range defined by the above-described formula (1) (step S302). Next, the control unit 120 controls the recording head 118 to form an image on a first side of the paper 108 conveyed at the conveyance speed Va (step S303). Then, the single-sided printing ends.

In a case of the double-sided printing (step S301: YES), the control unit 120 determines whether the paper 108 is glossy paper (step S304). The print control information of the print data sent from the printer driver of the PC connected to the ink jet recording apparatus 1 includes control information for the paper 108 to be printed such as a type of paper used for printing or specification of a paper tray. The control unit 120, by analyzing the paper control information, determines the type of paper which is set or the type of paper accommodated in the specified paper tray, and determines whether the paper 108 to be printed on is a glossy paper.

Moreover, for example, in a case where the type of paper to be printed on, the paper tray or the like can be set by using the operation panel 140 in the ink jet recording apparatus 1, the control unit 120 acquires control information stored in a memory or the like, and determines whether the paper 108 to be printed on is glossy paper.

In a case where the paper 108 is glossy paper (step S304: YES), the control unit 120 sets the conveyance speed Va for the paper 108 to a predetermined value in the range defined by the above-described formula (1) (step S305). Next, an image is formed on a first side and a second side of the paper 108 conveyed at the conveyance speed Va (step S306). In this case, the first side printing for the paper 108 is performed upon the paper 108 passing the image formation position opposed to the recording head 118 in either direction.

In a case where the paper 108 is not glossy paper (step S304: NO), the control unit 120 sets the conveyance speed Vb for the paper 108 to a predetermined value in the range defined by the above-described formula (2) (step S307). Next, the control unit 120 controls the recording head 118 to perform image formation twice on a first side of the paper 108 which is reciprocatingly conveyed at the conveyance speed Vb, and forms an image on the first side of the paper 108 (step S307).

Subsequently, the control unit 120 sets a conveyance speed Va for the paper 108 to a predetermined value in the range defined by the above-described formula (1) (step S309). Next, the control unit 120 controls the recording head 118 to form an image on a second side of the paper 108 conveyed at the conveyance speed Va (step S310). Then, the process ends.

In this way, in the case where the paper 108 is glossy paper, by reducing the conveyance speed upon performing the first side printing of the double-sided printing to secure time for ink drying, contamination inside the apparatus can be prevented. Moreover, in the case where the paper 108 is not glossy paper, the conveyance speed upon performing the first side printing of the double-sided printing is speeded up, thereby productivity is enhanced. Meanwhile, in the above explanation, glossy paper is used as an example. However, the present embodiment is not limited to this. By performing similar print processes for a recording medium on which ink is hard to dry, contamination inside the apparatus can be prevented.

(Maintenance)

In order to prevent an occurrence of clogging in the nozzles of the recording head 118 by not using it for a long period, in the ink jet recording apparatus 1 according to the present embodiment, the recording head 118 executes a recovery operation such as an idle discharge after a predetermined maintenance time elapses.

The ink jet recording apparatus 1 is provided with an idle discharge receiver for receiving ink droplets by an idle discharge by the recording head 118 in a non-printing region where the paper 108 does not pass and within a range where the recording head 118 can move in the main scanning direction. The recording head 118, in a case where the maintenance time has elapsed since the idle discharge was executed previously, moves to an idle discharge position where the idle discharge receiver is placed, and executes the idle discharge, thereby an occurrence of trouble such as clogging can be prevented.

Figure 10:
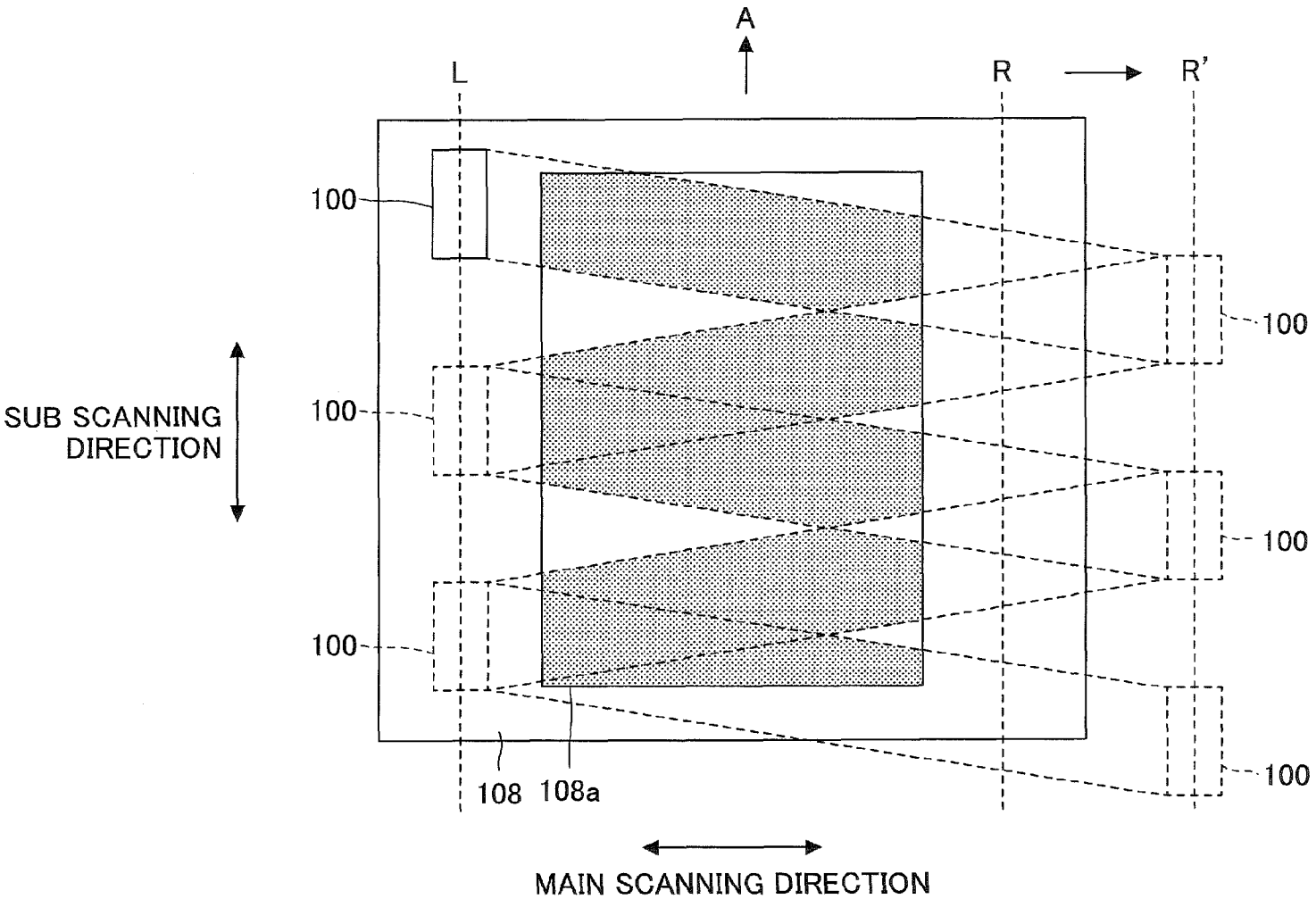
FIG. 10 is a diagram for explaining an example of a print operation during maintenance in the ink jet recording apparatus according to the present embodiment.

Here, in the ink jet recording apparatus 1 according to the present embodiment, in a case where the maintenance time has elapsed during printing and the idle discharge is executed, as shown in FIG. 10, one turnover position in the main scanning direction is changed from a position "R" to a position "R'" so that the recording head 118 passes the idle discharge position. After the turnover position of the recording head 118 is changed, the recording head 118 reciprocatingly scans between a position "L" and the position "R'", executes the idle discharge at the idle discharge position as necessary, and forms an image in a print region 108*a* of the paper 108 which is conveyed continuously.

In a case where, for example, in the middle of execution of printing by the recording head 118 reciprocatingly scanning between the position "L" and the position "R", in order to perform the idle discharge the turnover position is moved to the position "R'", the idle discharge is performed, and thereafter the turnover position is returned to the position "R" and the printing is continued, an image may be formed in an irregular region. In this way, in the case where the turnover position of the recording head 118 is changed during printing, a space in which an image is not formed may be possibly left in the printing region 108*a* on the paper 108.

However, in the ink jet recording apparatus 1 according to the present embodiment, in the case where the maintenance time has elapsed during printing, the turnover position of the recording head 118 is changed to the position "R'" from the beginning of the printing to the completion of the printing. The turnover position of the recording head 118 is not changed during printing, while executing the idle discharge as necessary, an image can be formed in the whole printing region 108*a* of the paper 108.

Figure 11:
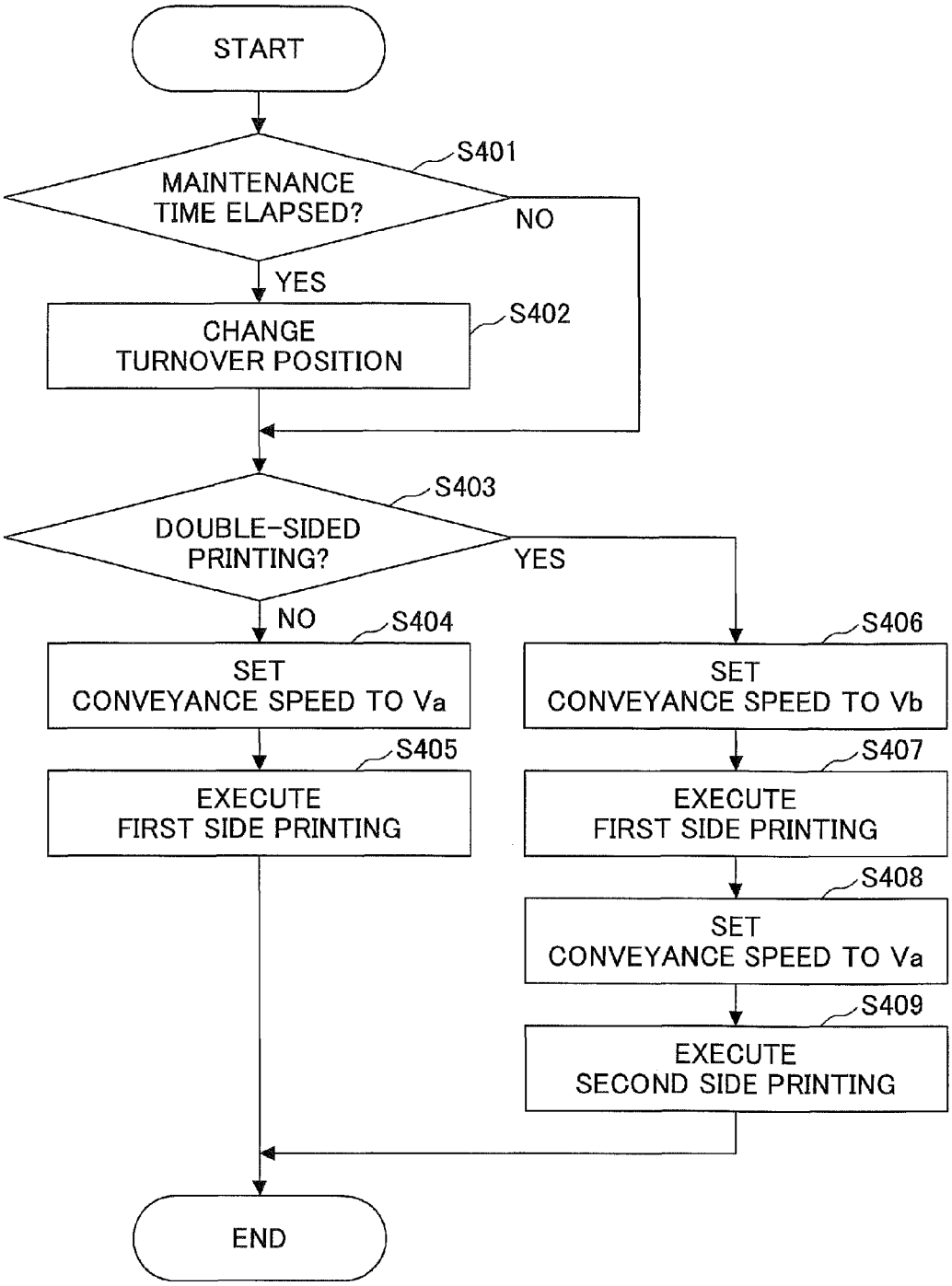
FIG. 11 is a flowchart illustrating a fourth example of a print process according to the present embodiment.

FIG. 11 is a flowchart illustrating an example of a print process that changes a turnover position in a case where the recording head 118 performs the idle discharge.

As shown in FIG. 11, when a print request is inputted to the ink jet recording apparatus 1, the control unit 120 determines whether an elapsed time from previous execution of the idle discharge exceeds a maintenance time, which is preliminarily set, during execution of printing (step S401).

In a case where the elapsed time from the execution of the idle discharge during the execution of printing exceeds the maintenance time (step S401: YES), the turnover position is changed from the position "R" to the position "R'" as shown in FIG. 10, for example, so that the recording head 118 passes the idle discharge position (step S402). Moreover, in a case where the elapsed time from the execution of the idle discharge during the execution of printing does not exceed the maintenance time (step S401: NO), since it is not necessary to execute the idle discharge, the turnover position of the recording head 118 is not changed.

Next, the control unit determines whether the inputted print request is for a single-sided printing or a double-sided printing (step S403). The control unit 120 determines whether it is for the single-sided printing or the double-sided printing by analyzing print control information included in print data sent from a printer driver of a PC connected to the ink jet recording apparatus 1.

In a case of the single-sided printing (step S403: NO), the control unit 120 sets a conveyance speed Va for the paper 108 to a predetermined value within the range defined by the above-described formula (1) (step S404). Next, the control unit 120 controls the recording head 118 to form an image on a first side of the paper 108 conveyed at the conveyance speed Va (step S405). Then, the single-sided printing ends.

In a case of the double-sided printing (step S403: YES), the control unit 120 sets a conveyance speed Vb for the paper 108 to a predetermined value within the range defined by the above-described formula (2) (step S406). Next, the control unit 120 controls the recording head 118 to perform image formation twice on a first side of the paper 108 which is reciprocatingly conveyed at the conveyance speed Vb, and forms an image on the first side of the paper 108 (step S407).

Subsequently, the control unit 120 sets a conveyance speed Va for the paper 108 to a predetermined value in the range defined by the above-described formula (1) (step S408). Next, the control unit 120 controls the recording head 118 to form an image on a second side of the paper 108 conveyed at the conveyance speed Va (step S409). Then, the process ends.

In a case where the turnover position is changed so that the recording head 118 passes the idle discharge position, the recording head 118 executes idle discharge at any of timings of passing the idle discharge position. In this way, by the recording head 118 executing the idle discharge at the idle discharge position, clogging of the nozzles can be prevented. Moreover, even in the case of executing the idle discharge during printing, the turnover position of the recording head 111 does not change during printing, the control unit 12 controls the recording head 118 so as to reciprocatingly scan, and can form an image in the whole print region 108*a* of the paper 108.

As described above, in the ink jet recording apparatus 1 according to the present embodiment, since the recording head 118 forms an image on the paper 108 which is continuously conveyed, mechanical sounds occurring at a start and an end of operation of the conveyance belt 101 or the like are reduced and quietness is enhanced.

Moreover, in the ink jet recording apparatus 1 according to the present embodiment, the first side printing of the double-sided printing is performed while the paper 108 is reciprocatingly conveyed at the conveyance speed Vb which is greater than the conveyance speed Va upon performing the single-sided printing. Therefore, in the ink jet recording apparatus 1 according to the present embodiment, the double-sided printing can be performed more quickly, compared with the case of, for example, printing from the beginning of the first side printing to the end of the second side printing at the constant conveyance speed Va, and productivity for the double-sided printing is enhanced.

As described above, the image forming apparatus and the image forming method according to the present embodiment are explained. However, the present invention is not limited to the above-described embodiments, but various variations and modifications may be made without departing from the scope of the present invention. The present invention is not limited to an ink jet type image forming apparatus, and can be applied to an image forming apparatus provided with a recording head which reciprocatingly scans in a main scanning direction a recording medium, which is conveyed in a sub scanning direction, and forms an image on the recording medium.

What is claimed is:

1. An image forming apparatus comprising:

a conveyance unit configured to convey a recording medium in a sub scanning direction;

a recording head configured to reciprocatingly scan in a main scanning direction perpendicular to the sub scanning direction, to form an image on the recording medium conveyed by the conveyance unit;

a reversing unit configured to reverse front and back sides of the recording medium and convey the reversed recording medium to the conveyance unit; and a control unit configured to control a conveyance speed at which the conveyance unit conveys the recording medium, wherein in a case of performing a double-sided printing, during the conveyance unit reciprocatingly conveying the recording medium, the recording head is controlled to form a first image on a first side of the recording medium, and during the conveyance unit conveying and ejecting the reversed recording medium, front and back sides of which are reversed by the reversing unit, the recording head is controlled to form a second image on a second side of the recording medium, and wherein the control unit is configured to control a first conveyance speed $V_1$ upon forming the first image on the first side of the recording medium and a second conveyance speed $V_2$ upon forming the second image on the second side of the recording medium to satisfy a relation $$V_2 \leq W/t < V_1 \leq (W/t) \times 2$$

where t is a scanning time required for one reciprocation of the recording head in the main scanning direction, and W is an image formation width of the recording head in the sub scanning direction.

2. The image forming apparatus as claimed in claim 1, wherein the control unit is configured to control the first conveyance speed $V_1$ and the second conveyance speed $V_2$ to satisfy the relation in a case where a high-speed double-sided printing mode is set.

3. The image forming apparatus as claimed in claim 1, wherein the recording head is configured to discharge ink on the recording medium, to form the image.

4. The image forming apparatus a claimed in claim 3, wherein the recording head is configured to change a turnover position to a position which passes an idle discharge position, at which the recording head executes an idle discharge, in a case where an elapsed time from previous execution of the idle discharge becomes greater than or equal to a predetermined time while executing printing.

5. An image forming method in an image forming apparatus, which includes:

a conveyance unit configured to convey a recording medium in a sub scanning direction;

a recording head configured to reciprocatingly scan in a main scanning direction perpendicular to the sub scanning direction, to form an image on the recording medium conveyed by the conveyance unit; and a reversing unit configured to reverse front and back sides of the recording medium and convey the reversed recording medium to the conveyance unit, wherein in a case of performing a double-sided printing, while the conveyance unit reciprocatingly conveys the recording medium, the recording head is configured to form a first image on a first side of the recording medium, and while the conveyance unit conveys and ejects the reversed recording medium, front and back sides of which are reversed by the reversing unit, the recording head is configured to form a second image on a second side of the recording medium, the method comprising controlling a first conveyance speed $V_1$ at which the conveyance unit conveys the recording medium upon forming the first image on the first side of the recording medium and a second conveyance speed $V_2$ at which the conveyance unit conveys the reversed recording medium upon forming the second image on the second side of the recording medium to satisfy a relation $$V_2 \leq W/t < V_1 \leq (W/t) \times 2$$

where t is a scanning time required for one reciprocation of the recording head in the main scanning direction, and W is an image formation width of the recording head in the sub scanning direction.

* * * * *